US005378195A

United States Patent [19]

Beck

[11] Patent Number: 5,378,195

[45] Date of Patent: Jan. 3, 1995

[54] FUME HOOD WITH BAFFLE CONTROL LINKAGE

[75] Inventor: Marshall K. Beck, Manitowoc, Wis.

[73] Assignee: Fisher Hamilton Scientific Inc., Two Rivers, Wis.

[21] Appl. No.: 948,949

[22] Filed: Sep. 18, 1992

[51] Int. Cl.[6] ..... B08B 15/02

[52] U.S. Cl. ..... 454/62

[58] Field of Search ..... 454/56, 61, 62

[56] References Cited

U.S. PATENT DOCUMENTS 2,779,265 1/1957 Liptay ..... 454/62
4,434,711 3/1984 Zboralski et al. ..... 454/62
4,785,722 11/1988 Dollhopf et al. ..... 454/62

FOREIGN PATENT DOCUMENTS 2088043 6/1982 United Kingdom ..... 454/62

*Primary Examiner*—Harold Joyce
*Attorney, Agent, or Firm*—Tilton, Fallon, Lungmus & Chestnut

[57] ABSTRACT

A fume hood with at least one adjustable baffle includes a baffle control linkage for adjusting the position of the baffle. This baffle control linkage includes a first pivoting member, a second pivoting member, a handle for driving the first pivoting member, and a linking device for connecting the first and second pivoting members.

7 Claims, 2 Drawing Sheets

FUME HOOD WITH BAFFLE CONTROL LINKAGE

BACKGROUND OF THE INVENTION

1. Field of the Invention

The present invention relates to a fume hood with a baffle control linkage. More particularly, this invention relates to a fume hood with a control linkage which allows an operator to adjust a baffle disposed at the rear of the fume hood by manipulating a handle at the front of the fume hood.

2. Description of the Prior Art

In many applications, fume hoods must exhaust lighter than air and heavier than air fumes. For exhausting lighter than air fumes, a fume hood should include a baffle system which allows the blower of the fume hood to pull air from an upper portion of the hood chamber. For exhausting heavier than air fumes, the baffle system should allow the blower to pull air from a bottom portion of the hood chamber.

The fume hood described in U.S. Pat. No. 4,434,711 includes a baffle system and an assembly for adjusting a damper used with the baffle system. The damper assembly for this fume hood includes a control handle which a user may move inwardly or outwardly of the fume hood and lock into a particular position. Some operators, e.g. the disabled, find tis control handle and damper assembly difficult to operate. In addition, when the handle extends a substantial distance outwardly of the fume hood, it may snag clothing or act as an obstruction.

The fume hood of the present invention has baffle control linkage which allows easy and quick adjustment of the baffle system. It meets the requirements of the Americans With Disabilities Act; and it minimizes the outwardly extension of a control handle. In addition, it allows easy removal of the baffles from the fume hood for cleaning and repair. It is a simple assembly which minimizes the cost of manufacture and assembly and gives precise, uniform and reliable performance.

SUMMARY OF THE INVENTION

In accordance with one embodiment of this invention a fume hood includes a housing which defines a chamber an front access opening for the chamber. The housing also includes a front panel and inner and outer side panels. A baffle assembly with at least one baffle pivotally mounted to the rear of the chamber cooperates with a blower to evacuate the chamber of fumes. A linkage control assembly allows an operator to adjust this baffle.

The baffle control linkage includes a first pivoting member pivotally mounted to the fume hood housing proximate the front of the housing. It also includes a second pivoting member pivotally mounted to the housing proximate the baffle; handle means secured to the first pivoting member for driving the first pivoting member; and a linking means for connecting the first and second pivoting member. The second pivoting member includes a portion which extends into the chamber and releasably engages the baffle.

An operator may move the handle means, and thus the first pivoting member, between predetermined limits. The linkage means transfers the movements of the first pivoting member to the second pivoting member. The second pivoting member rotates and moves the baffle which lies pivotally mounted, at its bottom edge, to the fume hood housing.

BRIEF DESCRIPTION OF THE DRAWINGS

For a more complete understanding of the present invention, one should now refer to the embodiment illustrated in greater detail in the accompanying drawings and described below as an example of the invention. In the drawings.

While the following describes the invention in connection with one embodiment, one should understand that the invention is not limited to this embodiment. Furthermore, one should understand that the drawings are not to scale and that graphic symbols, diagrammatic representations, and fragmentary views may, in part, illustrate the embodiment. In certain instances, the disclosure may not include details which are not necessary for the understanding of the present invention.

DETAILED DESCRIPTION OF THE DRAWINGS

Figure 1:
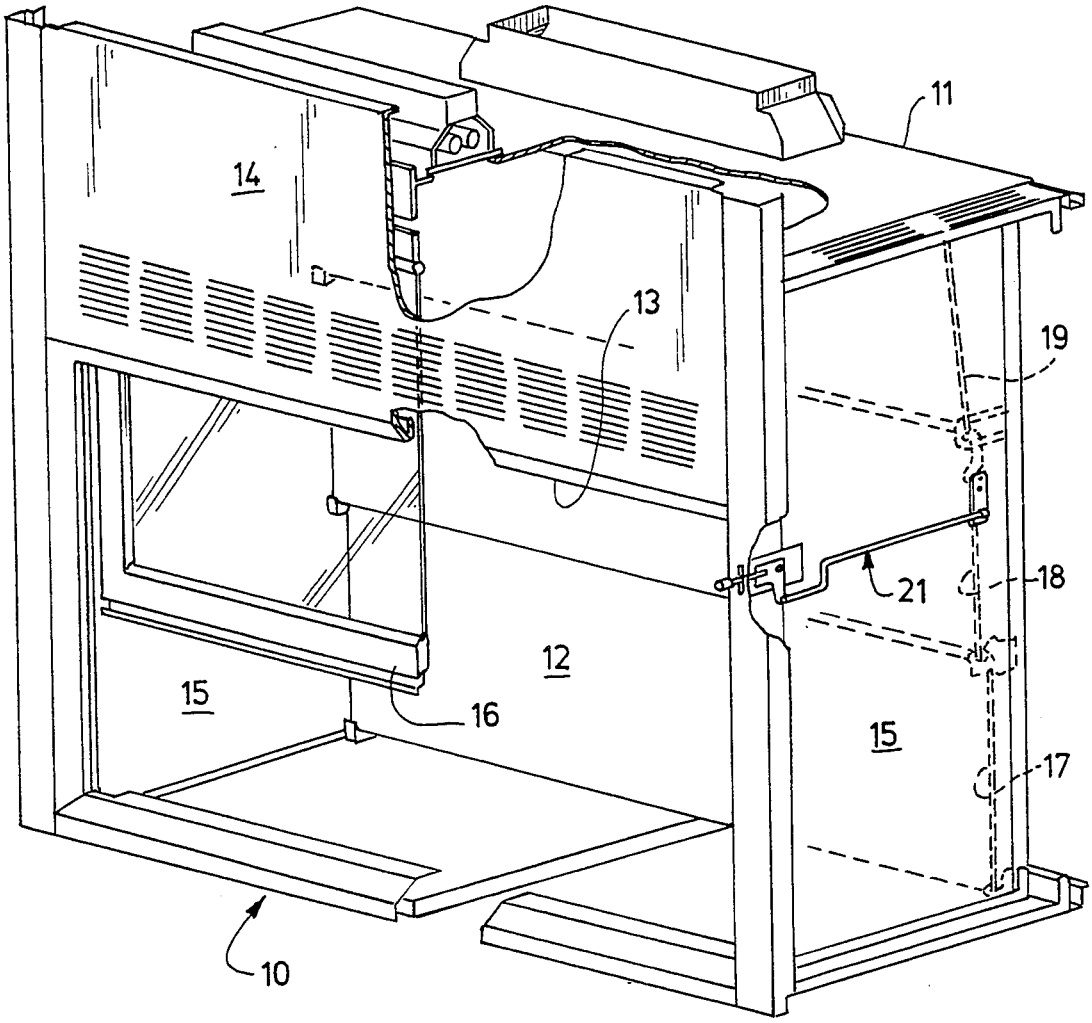
FIG. 1 is a perspective view of the fume hood of the present invention, showing the baffle control linkage.

In the illustration given and with reference to FIG. 1, the numeral 10 designates the fume hood of the present invention. This fume hood generally includes a housing 11 and a blower (not shown). The housing defines a chamber 12 with a front opening 13 and comprises inner and outer panels, including a front panel 14, inner side panels 15, and outer side panels (not shown). A sash 16 slidably mounted to the portions of the housing 11 adjacent the chamber opening 13 opens and closes the opening 13. The housing 11 and the various components described below are members made out of metal, hard plastic, or any other material of sufficient strength, rigidity and corrosion resistance.

Figure 2:
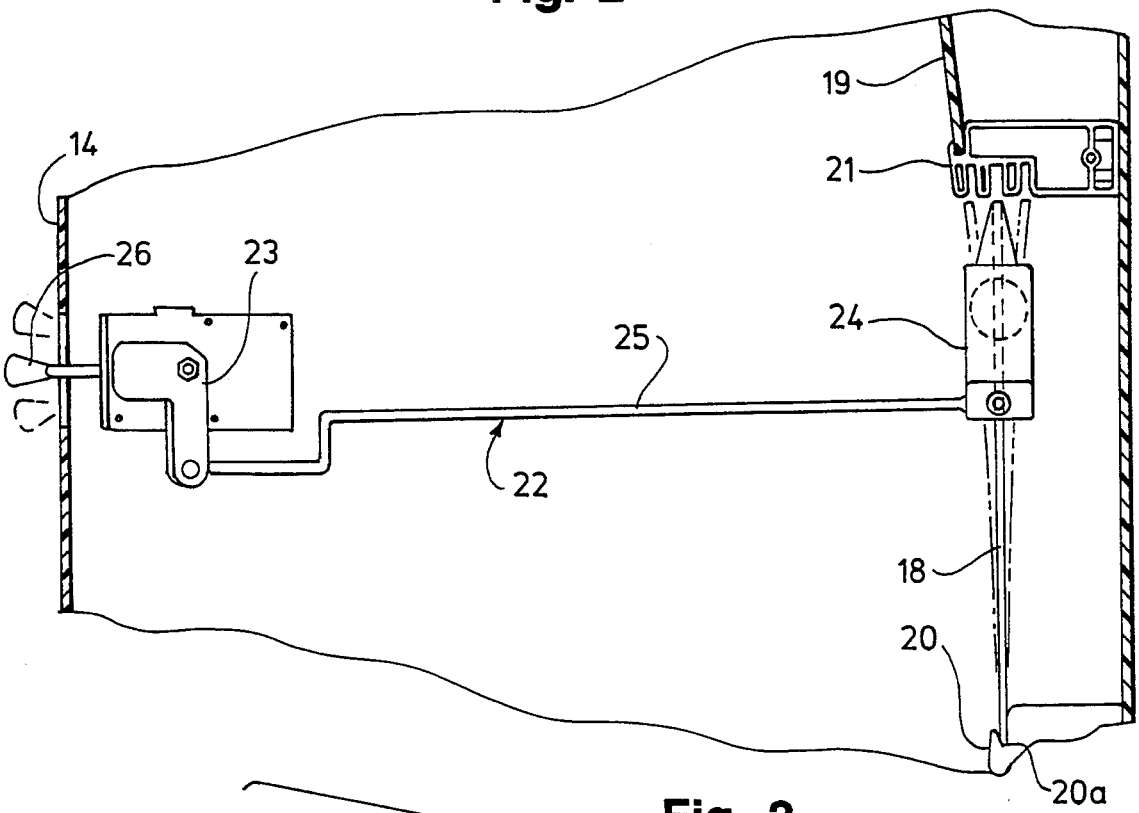
FIG. 2 is a side elevation view of the baffle control linkage.

A baffle system, including a lower baffle plate 17, a middle baffle plate 18 and a top baffle plate 19 disposed in the chamber 12, cooperates with the blower to exhaust fumes from the chamber 12. These baffle plates are made of cement board or a polyester material. Alternatively, they may be made of polyvinyl chloride, polypropylene, or any other suitable materials. The baffle plates 17–19 lie in the chamber 12 releasably secured to the back of the fume hood housing. Certain clip and bracket structures made of polyester or other suitable materials secure the baffles to the housing 11. These clips and brackets include brackets 20 (see FIG. 2) which support the bottom portion of baffle plate 18 and which hold the top of the bottom baffle plate 17. They also include brackets 21 which support the bottom portion of baffle plate 19.

A baffle control linkage 22 adjusts the position of the middle baffle plate 18 to increase or decrease the gap between the bottom end of the top baffle plate 19 and the top end of middle baffle plate 18. By closing this gap, the operator may direct the sucking action of the fume hood's blower to the bottom of the chamber 12, to a gap between the bottom edge of the plate 18 and the top edge of the plate 17 or between the bottom edge of the baffle plate 17 and the floor of the chamber 12. Thus, the blower may remove heavier than air fumes at the bottom of the chamber 12. By opening the gap, the operator may direct the suction to the gap so that the blower removes the lighter than air fumes at the top of the chamber 12.

The baffle control linkage 22 includes a firs pivoting member 23 pivotally mounted to the inner panel 15 proximate the front of the fume hood, a second pivoting member 24 pivotally mounted to the inner panel 15 proximate the back of the fume hood, a linking arm 25 which connects the first and second pivoting members 23 and 24, and a handle 26 fixedly secured to the first pivoting member 23. Suitable pivot connections secure one end of linking arm 25 to the first pivoting member 23 and the opposite end of the linking arm 25 to the second pivoting member 24.

Figure 3:
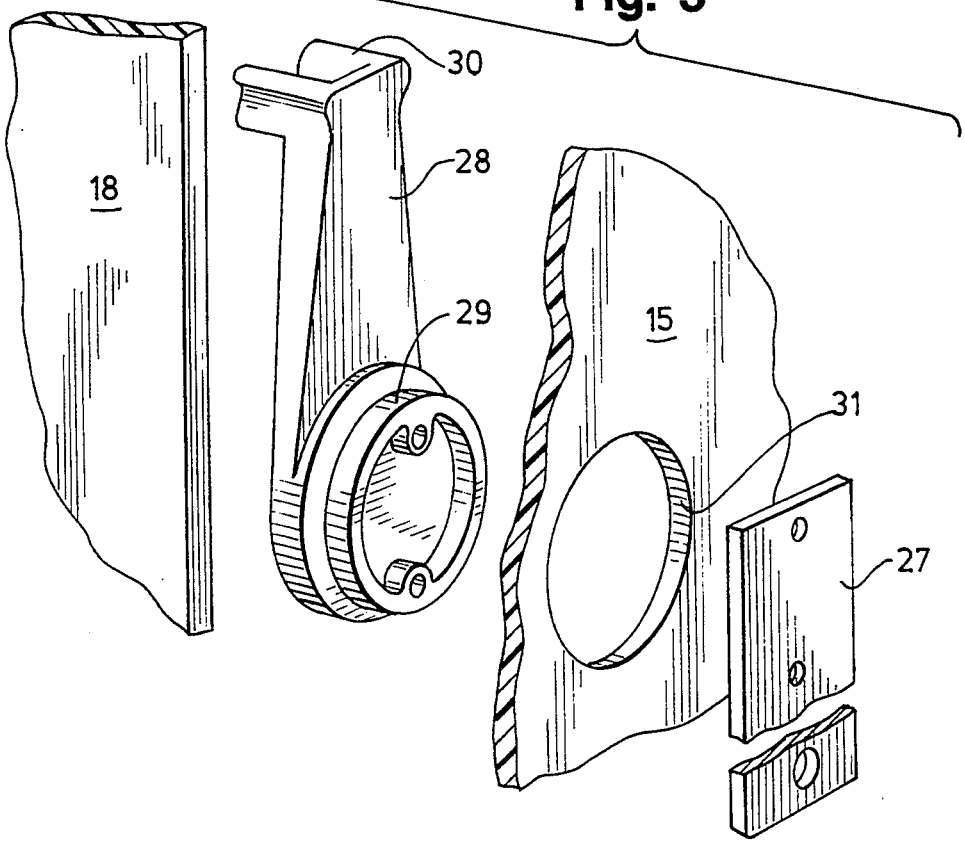
FIG. 3 is a partial perspective and exploded view of the second pivoting member of the baffle control linkage.

The second pivoting member 24 (See FIG. 3) include a first segment 27 which lies between an inner side panel 15 and an outer side panel and a second segment 28 which lies in the chamber 12. The segment 27 has one end pivotally connected to the linking arm 25 and the other end fixedly secured with bolts or similar means to the segment 28. The segment 28 is made of corrosion resistant material (e.g., polyester) and includes a pivoting portion 29 and a yoke portion 30. The pivoting portion 29 has a circular configuration and extends through a corresponding opening 31 defined by the inner panel 15. This opening 31 has a diameter slightly greater than the diameter of the pivoting portion 29 and allows the pivoting portion 29 to rotate within it. The yoke portion 30 receives a side edge portion of the middle baffle plate 18 which lies unsecured in the recess formed by the yoke portion. This yoke portion 30 allows easy removal of the baffle plate 18 for cleaning or repair.

When an operator moves the handle 26 in a clockwise or counter-clockwise direction, the first pivoting member 23 pivots in the same direction. The linking arm 25 transfers this movement to the second pivoting member 24 and drives the pivoting member 24 in the same direction of rotation as that of the pivoting member 23. When an operator moves the handle 26 upwardly, i.e., clockwise, the second pivoting member 24 tilts the middle baffle 18 rearwardly or clockwise. Conversely, when the operator moves the handle downwardly, the first and second pivoting members move counter-clockwise; and the second pivoting member tilts the middle baffle in a forward or counter-clockwise direction. The baffle plate 18 pivots in recesses 20*a* of the brackets 20. The top edge portion of the plate 18 does not engage the bottoms of the brackets 21 (See FIG. 2).

While the applicant has shown one embodiment of the present invention, one will understand, of course, that the invention is not limited to this embodiment, as those skilled in the art to which the invention pertains may make modifications and other embodiments of the principles of the invention, particularly upon considering the foregoing teachings. The applicant, therefore, by the appended claims, intends to cover any modifications and other embodiments which incorporate those features which constitute the essential features of this invention.

What is claimed is:

1. In a fume hood with a housing defining a chamber with a front opening, at least one baffle pivotally mounted, at its bottom end, to the housing at the rear of the chamber, and a baffle control linkage including: a first pivoting member pivotally mounted to the housing proximate the front of the housing; a second pivoting member pivotally mounted to the housing proximate the baffle for moving the baffle, said second pivoting member including means for releasably engaging the baffle and a yoke portion which receives a side edge portion of the baffle; handle means secured to the first pivoting member for driving the first pivoting member; and linking means for connecting the first and second pivoting members, one end of said linking means being pivotally connected to the first pivoting member and an opposite end being pivotally connected to the second pivoting member.

2. The fume hood of claim 1, wherein the housing includes outer and inner side panels and the baffle control linkage lies mounted between the outer and inner side panels.

3. The fume hood of claim 2, wherein the handle means extends outwardly of the outer and inner panels and the housing and the second pivoting member extends into the chamber of the fume hood to engage the baffle.

4. The fume hood of claim 1, wherein the first and second pivoting members pivot about substantially parallel axes.

5. In a fume hood with a housing defining a chamber with a front opening and including a front panel and inner and outer side panels, at least one baffle being pivotally mounted, at its bottom end, to the housing, a baffle control linkage being disposed substantially between the inner and outer side panels and including: a first pivoting member pivotally mounted to the housing proximate the front of the housing; a second pivoting member pivotally mounted to the housing proximate the baffle, said second pivoting member extending into the chamber of the fume hood and including a yoke portion for releasably engaging the baffle; handle means secured to the first pivoting member for driving the first pivoting member, said handle means extending outwardly of the housing through an opening in the front panel; linking means for connecting the first and second pivoting members, one end of said linking means being pivotally connected to the first pivoting member and an opposite end being pivotally connected to the second pivoting member; and the first and second pivoting members being pivotable about substantially parallel axes.

6. In a fume hood with a housing defining a chamber with a front opening, at least one baffle pivotally mounted to the housing and a baffle control linkage including: a pivoting member pivotally mounted to the housing proximate the baffle for releasably engaging an edge portion of the baffle and for moving the baffle; and a driving member for driving the pivoting member, said driving member including handle means for holding the driving member and connecting means for connecting the handle means with the pivoting member, said pivoting member including a yoke portion which receives an edge portion of the baffle.

7. In a fume hood with a housing defining a chamber with a front opening, at least one baffle pivotally mounted, at its bottom end, to the housing at the rear of the chamber, and a baffle control linkage including: a first pivoting member pivotally mounted to the housing proximate the front of the housing; a second pivoting member pivotally mounted to the housing proximate the baffle for moving the baffle, said second pivoting member including means for releasably engaging the baffle; handle means secured to the first pivoting member for driving the first pivoting member; and linking means for connecting the first and second pivoting members, one end of said linking means being pivotally connected to the first pivoting member and an opposite end being pivotally connected to the second pivoting member, the housing including outer and inner side panels and the baffle control linkage being mounted between the outer and inner side panels, the handle means extending outwardly of the outer and inner panels and the housing and the second pivoting member extending into the chamber of the fume hood to engage the baffle, the second pivoting member including a first segment disposed between the outer and inner side panels, the linkage means being pivotally secured to the first segment, and a second segment disposed substantially in the chamber, the second segment including a pivot portion which extends through an opening in an inner panel to engage the first segment and a yoke portion which receives a side edge portion of the baffle.

* * * * *